US011426757B1

(12) United States Patent
Zamarripa

(10) Patent No.: US 11,426,757 B1
(45) Date of Patent: Aug. 30, 2022

(54) CAULKING TOOL

(71) Applicant: Javier Mora Zamarripa, Burnaby (CA)

(72) Inventor: Javier Mora Zamarripa, Burnaby (CA)

( * ) Notice: Subject to any disclaimer, the term of this patent is extended or adjusted under 35 U.S.C. 154(b) by 368 days.

(21) Appl. No.: 16/687,007

(22) Filed: Nov. 18, 2019

(51) Int. Cl.
*B05C 17/10* (2006.01)
*E04F 21/32* (2006.01)
*E04F 21/165* (2006.01)

(52) U.S. Cl.
CPC ..... *B05C 17/10* (2013.01); *E04F 21/1652* (2013.01); *E04F 21/1655* (2013.01); *E04F 21/32* (2013.01)

(58) Field of Classification Search
CPC . E04F 21/165; E04F 21/1652; E04F 21/1655; E04F 21/38; E04F 21/30; E04F 21/32; B05C 17/00503; B05C 17/00506; B05C 17/0052
USPC ..... 15/325.3, 235.7, 236.09, 245.1
See application file for complete search history.

(56) References Cited

U.S. PATENT DOCUMENTS

2010/0278958 A1* 11/2010 Chamberlain ..... E04F 21/165 425/458

FOREIGN PATENT DOCUMENTS

DE 102013102021 A1 * 8/2014 ..... B05C 17/00516

OTHER PUBLICATIONS

Translation of DE102013102021 retrieved from Espacenet on Jan. 5, 2021 (Year: 2014).*

Dap, Dap Cap Caulk Finishing Tool, Website: https://www.grainger.com/product/4PMC7?gclid=EAIalQobChMlgsGjzZC75wlVCKrsCh0UUg3EEAQYBiABEgJ9jPD_BwE&cm_mmc=PPC:+Google +PLA&ef_id=EAIalQobChMlgsGjzZC75wlVCKrsCh0UUg3EEAQYBiABEgJ9jPD_BwE:G:s&s_kwcid=AL!2966!3!264955915652!!!g!467408784604, accessed Feb. 5, 2020, 2 pages.

* cited by examiner

*Primary Examiner* — Orlando E Aviles
*Assistant Examiner* — Thomas Raymond Rodgers
(74) *Attorney, Agent, or Firm* — Schacht Law Office, Inc.; Dwayne Rogge

(57) ABSTRACT

A caulking tool configured to be frictionally attached to a user's finger during use. The caulking tool in one example having; a convex caulk spreader comprising a pliable spreader surface configured to spread caulk smoothly between a first wall surface and a second wall surface to which the caulk is adhered. In one example junction between a first wall surface and a second wall surface will be in a corner junction between the two wall surfaces. In one example the caulking tool comprises a finger tube fixed to the caulk spreader. The finger tube may be cast with the spreader surface and thus forms a monolithic, single component without seams therebetween. The finger tube in one example having an inner surface configured to frictionally engage the outer surface of a user's finger. In one example the inner surface of the finger tube is tapered from a first longitudinal end to a second longitudinal end.

4 Claims, 3 Drawing Sheets

CAULKING TOOL

BACKGROUND OF THE DISCLOSURE

Field of the Disclosure

This disclosure relates to the field of tools for the even distribution of caulking and equivalents in a corner between and against two joining structures such as walls, floors, ceilings, and fixtures.

BRIEF SUMMARY OF THE DISCLOSURE

Disclosed herein are several improvements related to a caulking tool. The caulking tool in one example comprising; a convex caulk spreader comprising a pliable spreader surface configured to spread caulk smoothly between a first wall surface and a second wall surface to which the caulk is adhered. In one example junction between a first wall surface and a second wall surface will be in a corner junction between the two wall surfaces.

In one example the caulking tool comprises a frusta-conic finger tube fixed to the caulk spreader. In one example the finger tube is cast with the spreader surface and forms a monolithic, single component without seams therebetween. The finger tube in one example having an inner surface configured to frictionally engage the outer surface of a user's finger. Thus, as a user places their finger into the finger tube, their finger frictionally engages the inner surface of the finger tube and is attached thereto. In one example the inner surface of the finger tube is tapered from a first longitudinal end to a second longitudinal end. The second longitudinal end smaller in inner circumference than the first end. The taper may be a straight taper, or a curved taper as shown. The spreader surface having a longitudinal first end adjacent the first end of the finger tube and a second longitudinal end adjacent the second longitudinal end of the finger tube.

The caulking tool may be formed as a monolithic structure. This may be achieved by casting or other manufacturing methods where the entire device is a single component without seams.

The caulking tool may be arranged wherein the second longitudinal end of the finger tube is open and configured to allow passage of a user's fingertip. For users with especially small fingers, or users with long fingernails, this allows the users finger to frictionally engage the inner surface of the finger tube where it may not if the finger tube is closed on the second longitudinal end.

The caulking tool may be arranged wherein the spreader surface comprises a substantially planar first wing and substantially planar second wing extending bilaterally from a center ridge. These first and second wings engaging the wall surfaces as the tool is slid along them following a step of applying a volume of caulk or grout or equivalent to the corner between the wall surfaces. This action spreading the caulk to a smooth and even surface. The caulking tool may be arranged wherein the spreader surface comprises a caulk notch at the second longitudinal end. This notch configured to leave a specified thickness of grout in the corner for visual appeal, efficient curing, and/or fluid protection.

The caulking tool may be arranged wherein the spreader surface comprises one or more stiffeners extending from the spreader surface and configured to reduce longitudinal bending of the spreader surface. In one example the stiffeners vary in thickness from the spreader surface from a first thickness near the second longitudinal end of the spreader surface to a second thickness near the first longitudinal end of the spreader surface and the second thickness is greater than the first thickness. In one example the first thickness is substantially zero, such that this end of the stiffener does not protrude from the spreader surface.

DETAILED DESCRIPTION OF THE DISCLOSURE

Figure 1:
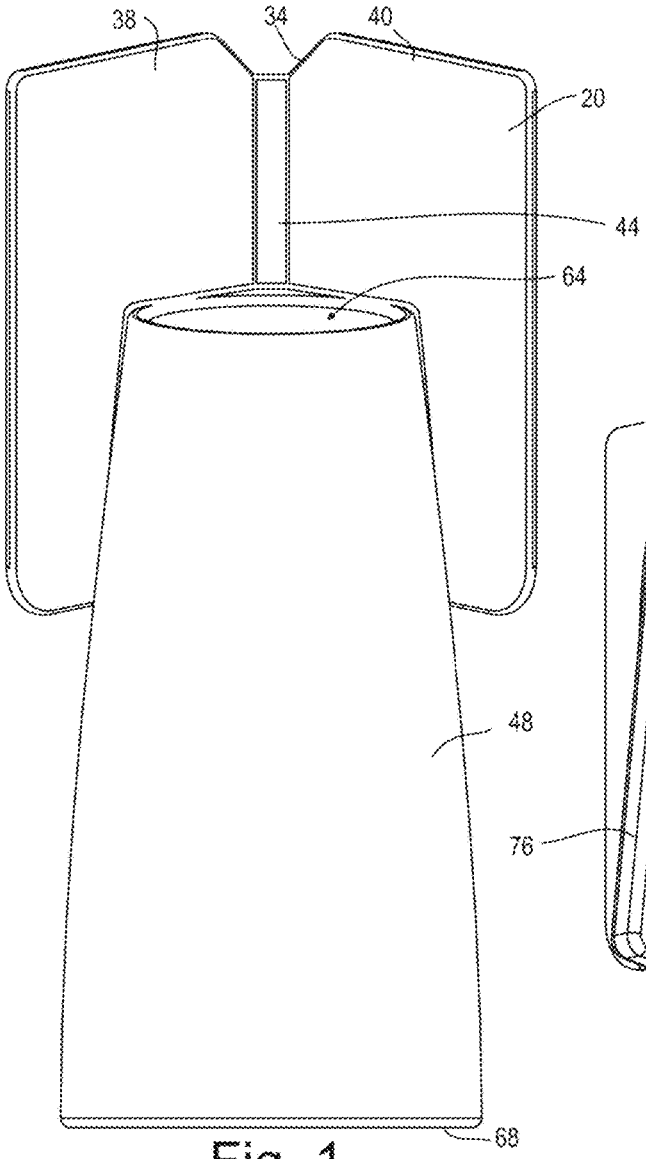
FIG. 1 is a top isometric view of one example of the caulking tool as shown and described.
Figure 2:
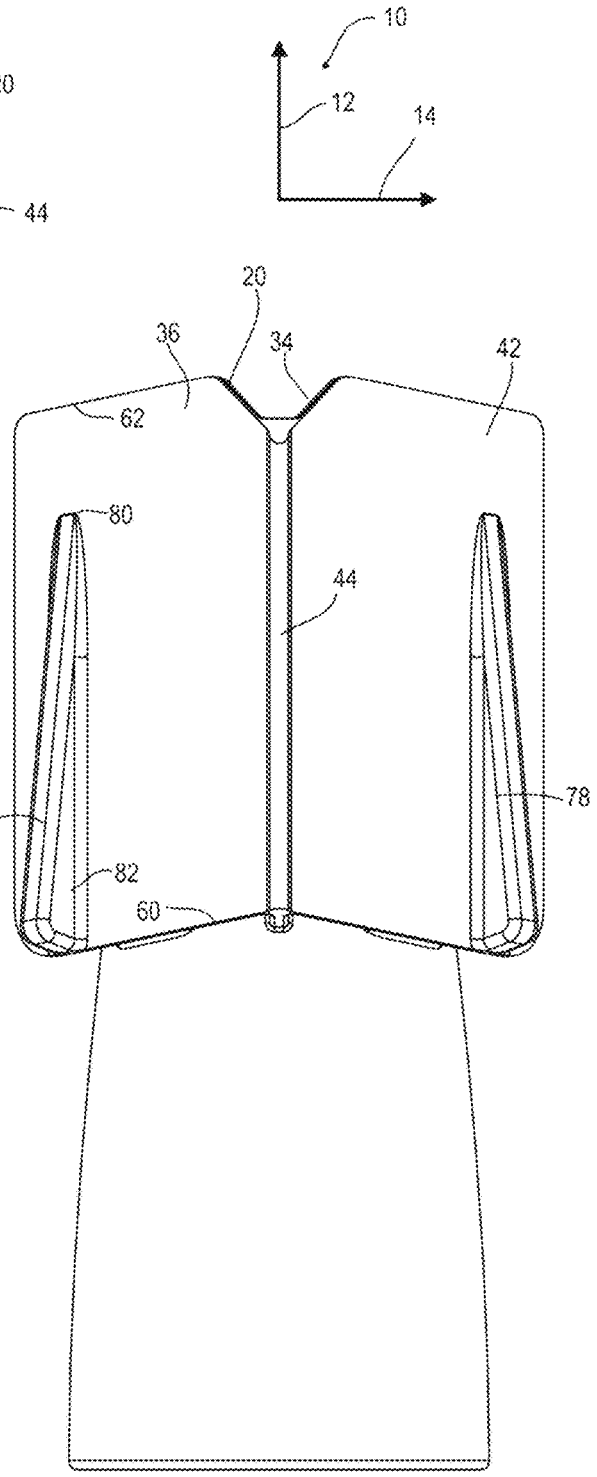
FIG. 2 is a bottom isometric view of the caulking tool shown in FIG. 1.
Figure 3:
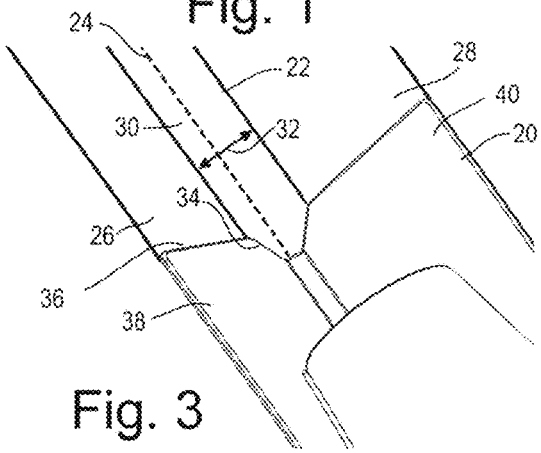
FIG. 3 is an enlarged view of the caulking tool of FIG. 1 in use.
Figure 4:
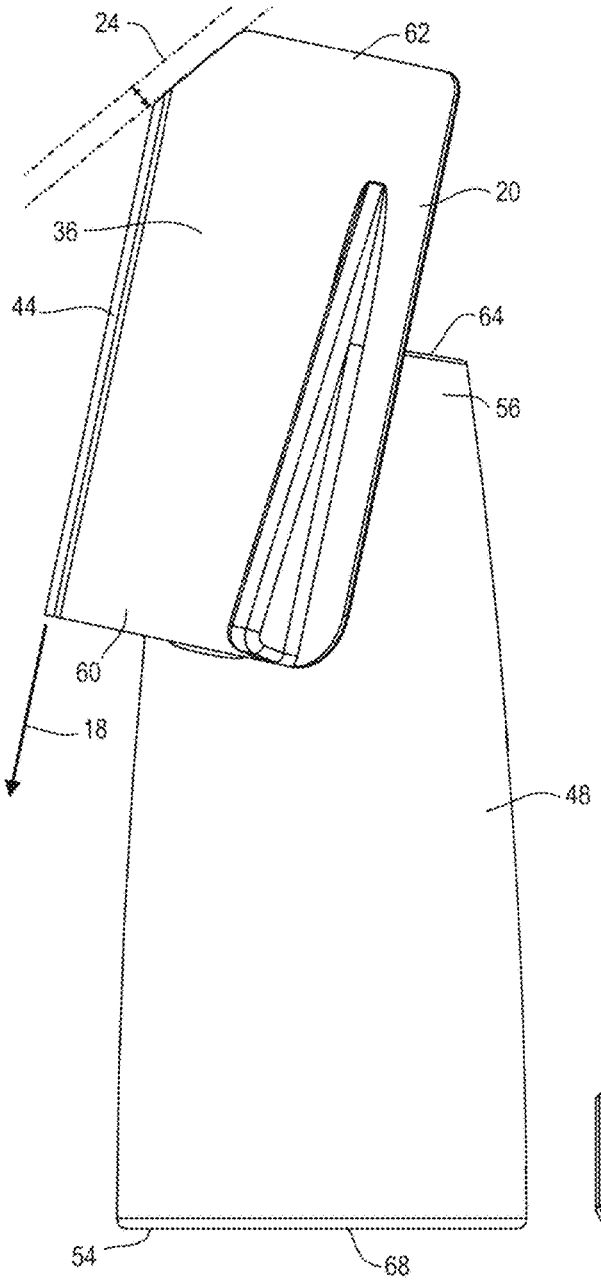
FIG. 4 is a side view of the disclosed caulking tool shown in FIG. 1 with the opposing side view being substantially a mirror image thereof.
Figure 5:
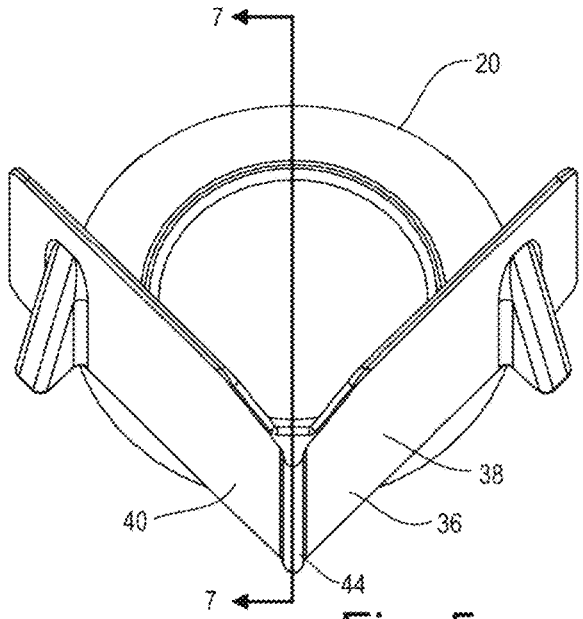
FIG. 5 is an end view of the disclosed caulking tool shown in FIG. 1.
Figure 6:
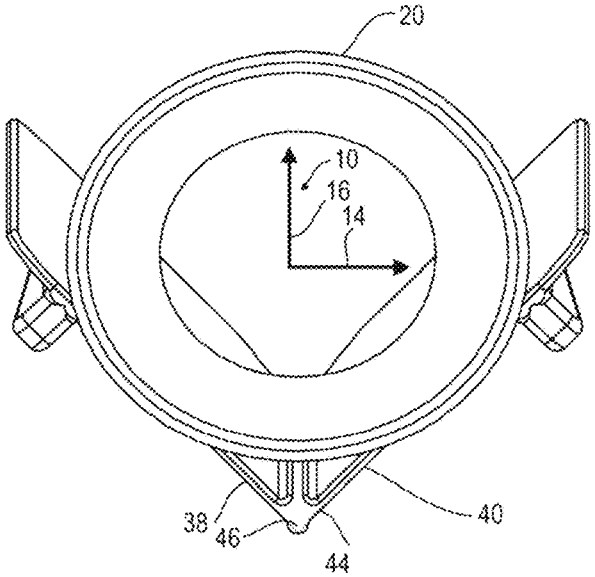
FIG. 6 is an opposing end view of the disclosed caulking tool.
Figure 7:
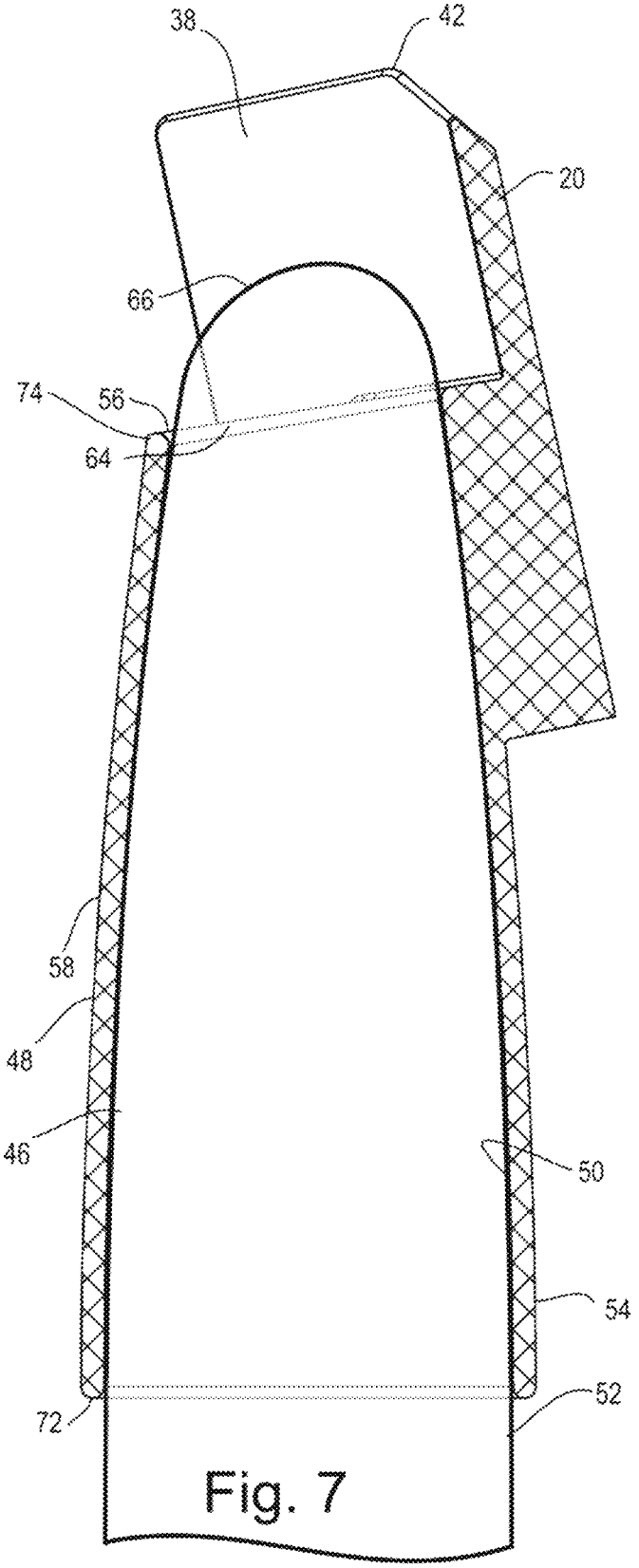
FIG. 7 is a cutaway view of the caulking tool shown in FIG. 1, taken along line 7-7 of FIG. 5.

Disclosed herein are several improvements related to a caulking tool 20 as shown in the accompanying drawings. The tool removably attached to a user's finger to improve spreading of caulk once the caulk is applied. The tool also used to substantially eliminate direct contact between the user's finger and the caulk during spreading. One common prior approach to spreading is for a user to directly contact the caulk with their finger, dragging their finger along the caulk, thus spreading the caulk in a moderately even distribution. This solution creates several problems, including cleaning of the user's finger, fingerprints in the hardened caulk, non-uniform hardened caulk, and potential health hazards with direct skin contact with the caulk.

When applying caulking 22 to a corner 24 between a first wall surface 26 and a second wall surface 28, the caulking is usually applied with from a tube by hand or while using a caulking gun. Such application results in an uneven, non-smooth, convex caulk surface. By sliding/dragging the caulking tool 20 over the applied caulking 22 prior to hardening, a smooth surface 30 can be achieved. In addition, the width 32 can be set by sizing a notch 34 to the desired width 32. This notch 34 may form a caulk width 32 of varying size, such as 3 mm, 5 mm, and 8 mm for example. Where the angle between the first wall 26 and second wall 28 is known, the width 32 also determines the thickness of the caulk 22. Where the caulking tool 20 comprises a spreading surface 36 comprising a first wing 38 and a second wing 40 extending bilaterally from the notch 34, the caulk 22 forms an isosceles triangle in cross section. Thus, the cross-sectional area of the caulking can be easily optimized for cure times, water resistance, visual appeal, etc.

The caulking tool 20 in one example comprising; a convex caulk spreader 42 comprising a spreader surface 36 configured to spread caulk 22 smoothly between a first wall surface 26 and a second wall surface 28 to which the caulk 22 is adhered. This smoothing step accomplished prior to hardening or curing of the caulk 22. In one example junction between a first wall surface 26 and a second wall surface 28 will be in a corner junction 24 between the two wall surfaces 26/28. The wall surfaces 26/28 may be the surfaces of a wall, floor, ceiling, bathtub, sink, baseboard, cabinet, or similar structures and fixtures or combinations thereof.

Before continuing, an axes system 10 is disclosed as shown in the figures. This axes system relative to the tool which may itself be oriented as needed. The axes system 10 comprising a longitudinal axis 12 parallel to the axis of the cone forming the finger tube. Also shown is a lateral axis 14 orthogonal to the longitudinal axis and parallel to the surface 30 of the caulk when smoothed. Also is disclosed a transverse axis 16 orthogonal to the longitudinal axis 12 and to the lateral axis 14. Also disclosed is a ridge axis 18 aligned with the ridge 44 between the first wing 38 and second wing 40.

To ease in use, the caulking tool 20 is specifically configured to attach to a user's finger 46. To accomplish this, the caulking tool 20 comprises a frusta-conic finger tube 48 fixed to the caulk spreader 42. In one example the finger tube 48 is cast with the spreader surface 36 and thus forms a monolithic, single component without seams therebetween. In one example the caulking tool 20 is cast of Acrylonitrile butadiene styrene (ABS). This allowing the finger tube 48 and wings 38/40 to be pliable when made thin enough and of a properly selected material. Testing has shown that wings formed of ABS at 0.5 mil±0.25 mil thick are pliable and easily used to conform to wall surfaces 26/28 with deviations and irregularities.

The finger tube 48 in one example having an inner surface 50 configured to frictionally engage the outer surface 52 of a user's finger. Thus, as a user places their finger 46 into the finger tube 48, their finger frictionally engages the inner surface 50 of the finger tube 48 and is attached thereto.

For improved comfort and stability of the caulking tool 20 on the user's finger 46, in one example the inner surface 50 of the finger tube 48 is tapered from a first longitudinal end 54 to a second longitudinal end 54. To better engage the user's finger 46, the second longitudinal end 56 may be smaller in inner circumference than the first longitudinal end 54.

The taper 58 of the inner surface 50 may be a straight taper, or a curved taper as shown. The taper 58 may also be parallel to the outer surface of the finger tube 48 where the thickness of the finger tube is even down the longitudinal length of the finger tube 48. The spreader surface 36 having a longitudinal first end 60 adjacent the first end 54 of the finger tube 48 and a second longitudinal end 62 adjacent the second longitudinal end 56 of the finger tube 48.

The caulking tool 20 may be arranged wherein the second longitudinal end 56 of the finger tube 48 has a surface defining an opening 64 configured to allow passage of a user's fingertip 66. For users with especially small fingers 46, or users with long fingernails, this opening 64 allows the user's finger 46 to frictionally engage the inner surface 50 of the finger tube where it may not if the finger tube 48 is closed on the second longitudinal end 56.

In one example, the first end opening 68 and or second end opening 64 comprise a rounded edge or bevel 72/74 respectively. This bevel increasing the comfort of the user.

The caulking tool may be arranged wherein the spreader surface comprises the substantially planar first wing 38 and the substantially planar second wing 40 extending bilaterally from the center ridge 44. These first and second wings 38/40 engaging the wall surfaces 26/28 as the caulking tool 20 is slid along the wall surfaces 26/28 along the uncured caulk 22 following a step of applying a volume of caulk 22 or grout or equivalent to the corner 24 between the wall surfaces 26/28. This sliding action spreading the caulk 22 to a smooth and even surface 30.

The caulking tool may be arranged wherein the spreader surface comprises a caulk notch 34 at the second longitudinal end. This notch 34 configured to leave a specified thickness and width 32 of caulk 22 in the corner 24 for visual appeal, efficient curing, and/or fluid protection as the caulk 22 adheres to both wall surfaces 26/28 and spans the gap therebetween forming a fluid seal.

The caulking tool 20 may be arranged wherein the spreader surface 36 comprises one or more braces or stiffeners 76/78 extending from the spreader surface 36 and configured to reduce longitudinal 12 bending of the spreader surface 36. In one example the stiffeners 76/78 vary in thickness from the spreader surface 36 from a first thickness 80 near the second longitudinal end 62 of the spreader surface to a second thickness 82 near the first longitudinal end 60 of the spreader surface 36 where the second thickness 82 is greater than the first thickness 80. In one example the first thickness 80 is substantially zero, such that this end of the stiffener 76/78 is substantially in the plane of the spreader surface.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A caulking tool comprising;

a caulk spreader comprising a pliable spreader surface configured to spread caulk smoothly between a first wall surface and a second wall surface to which the caulk is adhered;

a frusta-conic finger tube fixed to the caulk spreader;

the finger tube having an inner surface configured to frictionally engage the outer surface of a user's finger;

the inner surface of the finger tube tapered from a first longitudinal end to a second longitudinal end smaller in inner circumference than the first end;

the spreader surface having a longitudinal first end adjacent the first end of the finger tube and a second longitudinal end adjacent the second longitudinal end of the finger tube; wherein the spreader surface comprises a planar first wing and planar second wing extending bilaterally at opposing angles from a center ridge;

wherein each of the first wing and the second wing comprise one or more stiffeners laterally offset from the finger tube and extending parallel to the center ridge from the spreader surface and configured to reduce longitudinal bending of the spreader surface;

wherein the stiffeners are longitudinally offset from the second end of the spreader surface;

wherein the stiffeners vary in thickness from the spreader surface from a first thickness near the second longitudinal end of the spreader surface to a second thickness near the first longitudinal end of the spreader surface and the second thickness is greater than the first thickness;

wherein the first thickness is substantially zero wherein the spreader surface comprises a longitudinally recessed caulk notch at an edge of the second longitudinal end.

2. The caulking tool as recited in claim 1 formed as a monolithic structure.

3. The caulking tool as recited in claim 1 wherein the second longitudinal end of the finger tube is open and configured to allow passage of a user's fingertip.

4. The caulking tool as recited in claim 1 wherein the stiffeners are laterally offset from lateral edges of the spreader surface.

* * * * *